US006386441B2

(12) United States Patent
Philips

(10) Patent No.: US 6,386,441 B2
(45) Date of Patent: May 14, 2002

(54) SINGLE-PIECE PIZZA CONTAINER WITH FOLD AND HOLD MECHANISM

(75) Inventor: Nicholas A. Philips, Sugar Grove, IL (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/770,936

(22) Filed: Jan. 25, 2001

Related U.S. Application Data

(60) Provisional application No. 60/178,088, filed on Jan. 25, 2000.

(51) Int. Cl.[7] ..... B65D 5/20; B65D 5/66

(52) U.S. Cl. ..... 229/143; 229/148; 229/149; 229/155; 229/906

(58) Field of Search ..... 229/142, 143, 229/148, 149, 155, 902, 906

(56) References Cited

U.S. PATENT DOCUMENTS

| | | | | |
|---|---|---|---|---|
| 1,525,360 A | | 2/1925 | Blandford | |
| 1,616,014 A | | 2/1927 | Walter | |
| 1,726,108 A | | 8/1929 | Hughes | |
| 1,837,602 A | | 12/1931 | Walter | |
| 1,880,191 A | | 10/1932 | Bigelow | |
| 2,077,694 A | | 4/1937 | Hinton | |
| 2,472,674 A | | 6/1949 | Morand | |
| 2,784,900 A | | 3/1957 | Bauer | |
| 2,995,290 A | | 8/1961 | Swanson et al. | |
| 3,363,824 A | | 1/1968 | Murata | |
| 3,468,469 A | | 9/1969 | Kossoff et al. | |
| 3,510,051 A | | 5/1970 | Nordstrom | |
| 3,581,976 A | * | 6/1971 | Burgess | 229/148 |
| 3,669,341 A | | 6/1972 | Hughes | |
| 4,148,429 A | | 4/1979 | Burr et al. | |
| 4,197,981 A | | 4/1980 | Hamilton | |
| 4,236,740 A | | 12/1980 | Sorenson et al. | |
| 4,239,148 A | | 12/1980 | Sorenson et al. | |
| 4,244,507 A | | 1/1981 | Garmon | |
| 4,846,398 A | * | 7/1989 | Johnson | 229/143 |
| 4,913,340 A | | 4/1990 | Ilitch | |
| 5,056,710 A | | 10/1991 | Ritter | |
| 5,228,617 A | * | 7/1993 | McGrath | 229/148 |
| 5,289,970 A | | 3/1994 | McClure | |
| 5,411,204 A | | 5/1995 | DeMay | |
| 5,779,135 A | * | 7/1998 | Richardson | 229/155 |
| 5,853,121 A | | 12/1998 | Francisco | |
| 5,899,377 A | * | 5/1999 | Speese et al. | 229/155 |
| 6,135,347 A | * | 10/2000 | Mueller | 229/149 |

FOREIGN PATENT DOCUMENTS

| | | | | |
|---|---|---|---|---|
| GB | 2076782 A | * | 12/1981 | 229/149 |

* cited by examiner

*Primary Examiner*—Gary E. Elkins

(57) ABSTRACT

Embodiments of a pizza container are described using a container blank formed from a single piece of paperboard material. The container includes a bottom panel, first and second opposing side wall panels, and first and second opposing end wall panels. Each container further includes two top cover panels that fold over onto the container and act as lids. At least one U-shaped cut is formed along a hinge line connecting a top cover panel with an end wall panel. The U-shape has a closed side and an open side. The cut is oriented with the closed side extending into either the first end wall panel or the first top cover panel. The open side is positioned along the first hinge line. As assembled, the U-shaped portion is generally perpendicular with the panel from which it was formed. Various embodiment of lock mechanisms are described as well.

20 Claims, 8 Drawing Sheets

SINGLE-PIECE PIZZA CONTAINER WITH FOLD AND HOLD MECHANISM

RELATED INVENTIONS

This application claims priority under 35 U.S.C. 119(e) to Provisional Application No. 60/178,088, filed Jan. 25, 2000.

FIELD OF THE INVENTION

The present invention relates to paperboard containers, and more particularly to pizza-style containers formed from a single-piece blank.

BACKGROUND OF THE INVENTION

Pizza boxes are currently available in a wide variety of shapes and sizes. Many of the boxes include a square bottom panel, upright side walls, and a single lid panel that folds over the entire container. The side walls are typically formed as "roll-over" walls that require a person to fold a first panel around a second panel and then secure the second panel into place.

These style containers have a number of drawbacks. One disadvantage concerns the use of a single lid. As background information, many pizza establishments will use hundreds of pizza at a single location during the dinner and evening hours. The boxes are often completely or partially set up ahead of time for use during these rush periods. Setting up a conventional pizza box, however, takes time and labor, and which are costs that must be accounted for in the price of the pizza. In addition, there is the difficulty encountered in forming and using these boxes, and particularly those with rolled side walls. Forming a rolled side wall box can take more than an acceptable amount of time and can also place an employee at risk for "carpal tunnel syndrome" or similar disorder due to the wrist motion required to form the rolled walls.

Such single lids also suffer from the tendency for the lid to fail to maintain a closed position. When a pizza box lid pops open, the pizza product inside can suffer heat loss, and, depending on the circumstances, the pizza may become inadvertently contaminated. In addition, the closure mechanisms used to engage the lid can interfere with the top of the pie, resulting in a gooey, unappetizing mess.

Thus, a need exists for an improved pizza box which is easy to set up and handle, and which includes parts which may be secured together with a minimum effort to provide a practically permanent connection therebetween. A desirable feature would be the ability to eliminate most or all of the setup time required to form the pizza. Instead, ideally, the box would be formed after a pizza is laid on it. In addition, such a container would preferably avoid rolled side walls. This would help reduce set up time and would also allow a pizza cutter to cut through the perimeter crust of a pizza pie when the pie is placed in the box, without colliding with any vertical side walls. In addition, the structure of the box should allow the manufacturer to use the smallest possible box blank sheet size and lowest fiber weight, without comprising the benefits of the container. The present invention is directed to fulfilling these needs and others, as described below.

SUMMARY OF THE INVENTION

In accordance with aspects of the present invention, various improvements are described for a container blank formed from a single piece of paperboard material. The container includes a bottom panel, first and second opposing side wall panels, and first and second opposing end wall panels. Each container further includes two top cover panels that fold over onto the container and act as lids. A first top cover panel is connected to the first end wall panel along a first hinge line.

In accordance with other aspects of the invention, at least one U-shaped cut is formed along the first hinge line. The U-shape has a closed side and an open side. The cut is oriented with the closed side extending into either of the first end wall panel or the first top cover panel. The open side is positioned along the first hinge line. As assembled, the U-shaped portion is generally perpendicular with the panel from which it was formed.

In one embodiment, a lock mechanism is described having side flaps on one top cover panel. Slots formed in the side flaps and side walls engage one another to maintain a frictional closed relationship, with portions of the side flaps being inserted inward of the side walls and portions being located outward of the side walls. In another embodiment, a lock mechanism includes a tab formed on the exposed edge of one of the top cover panels. The tab is defined between a pair of transverse edge slots. As assembled, the outer edge of the other top cover panel is wedged under the tab by passing through the transverse edge slots.

In yet another embodiment, a lock mechanism includes side extensions in one top cover panel that insert into corresponding transverse cuts in the other top cover panel. In still another embodiment, a lock mechanism includes side protrusions formed in one top cover panel that insert into slits provided in the other top cover panel.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
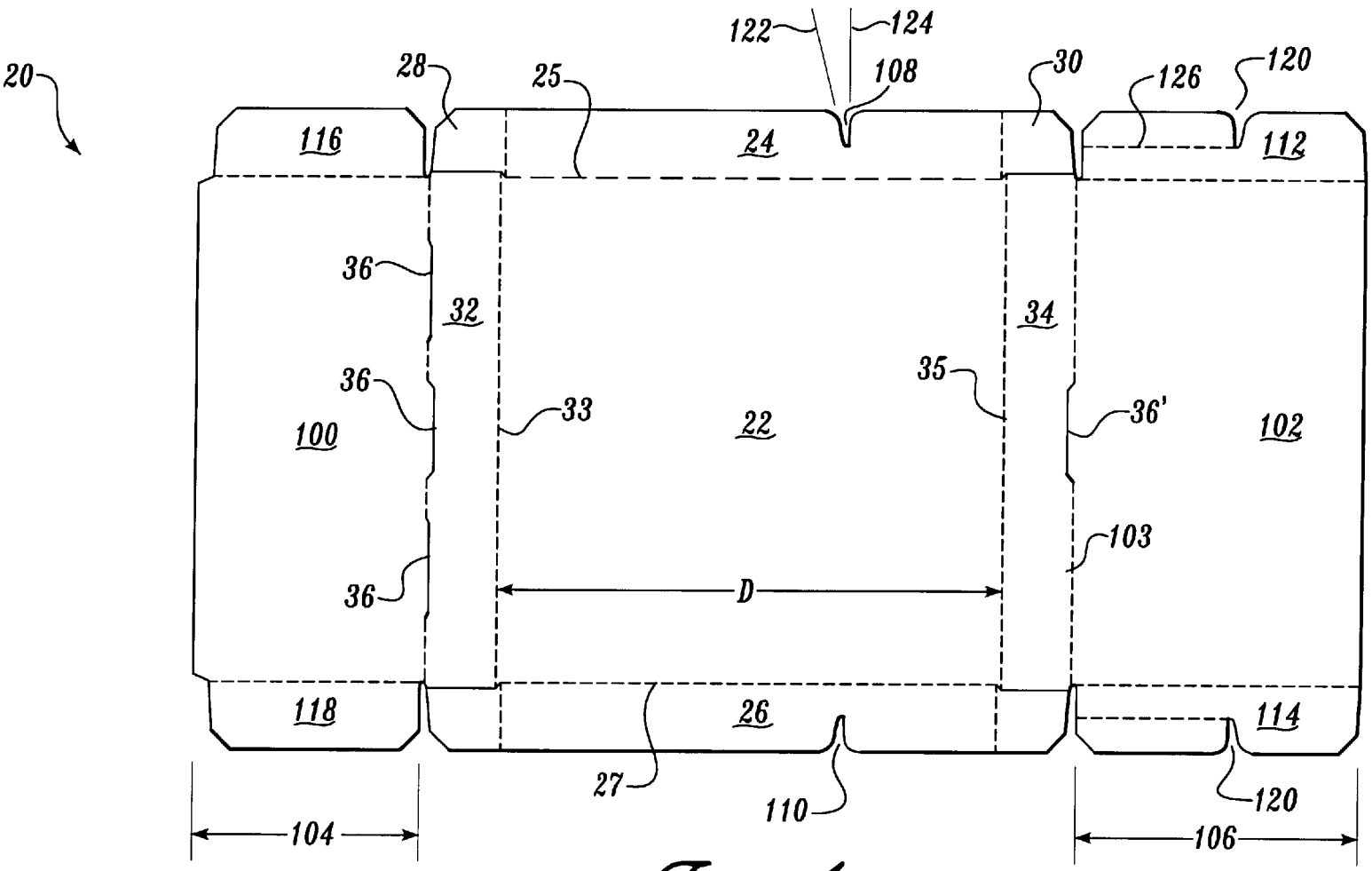
FIG. 1 is a first embodiment of a single-piece box blank formed in accordance with the present invention.
Figure 2:
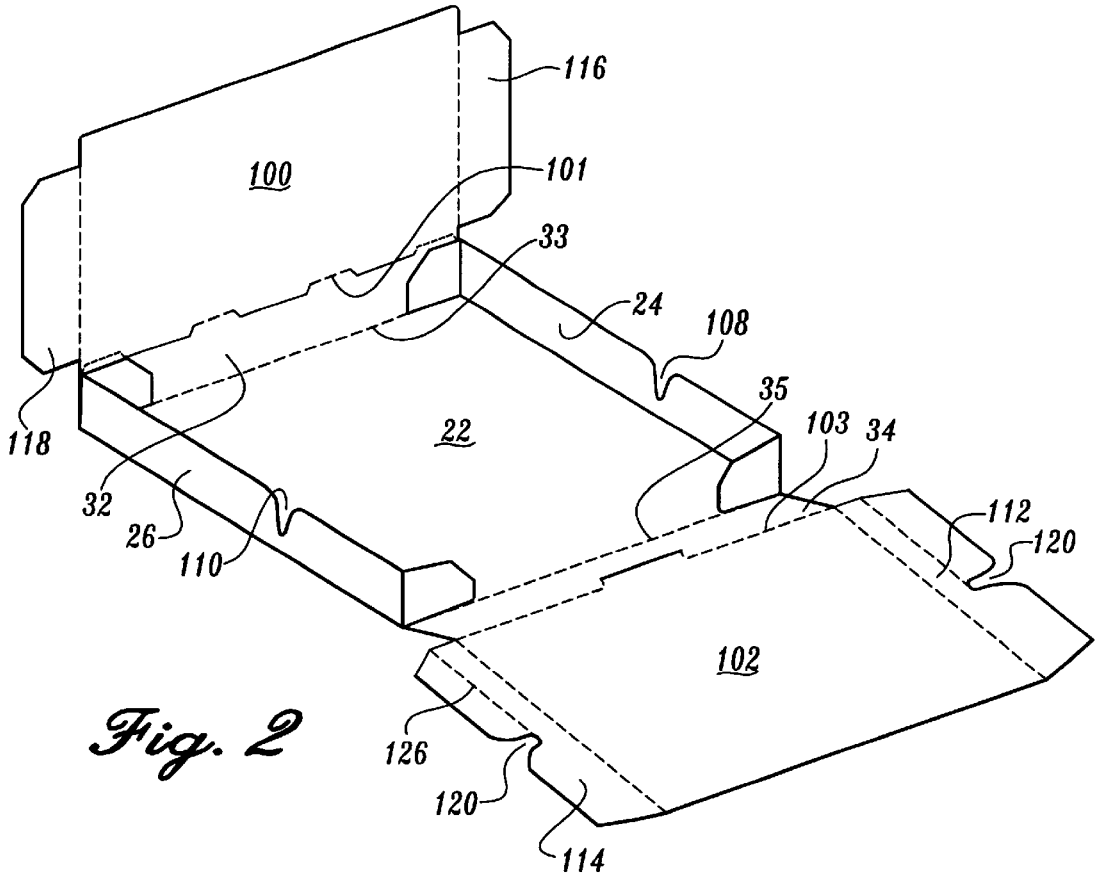
FIGS. 2 and 3 are isometric views illustrating assembly of the box of FIG. 1.
Figure 3:
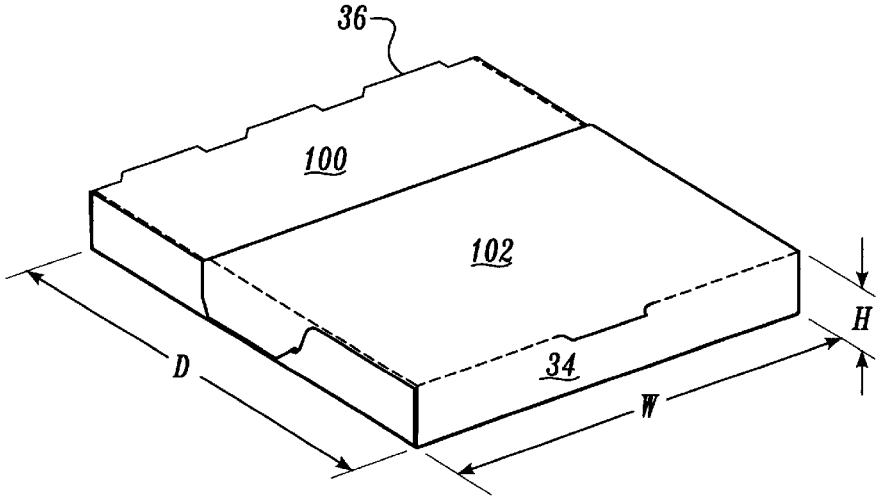
Figure 4:
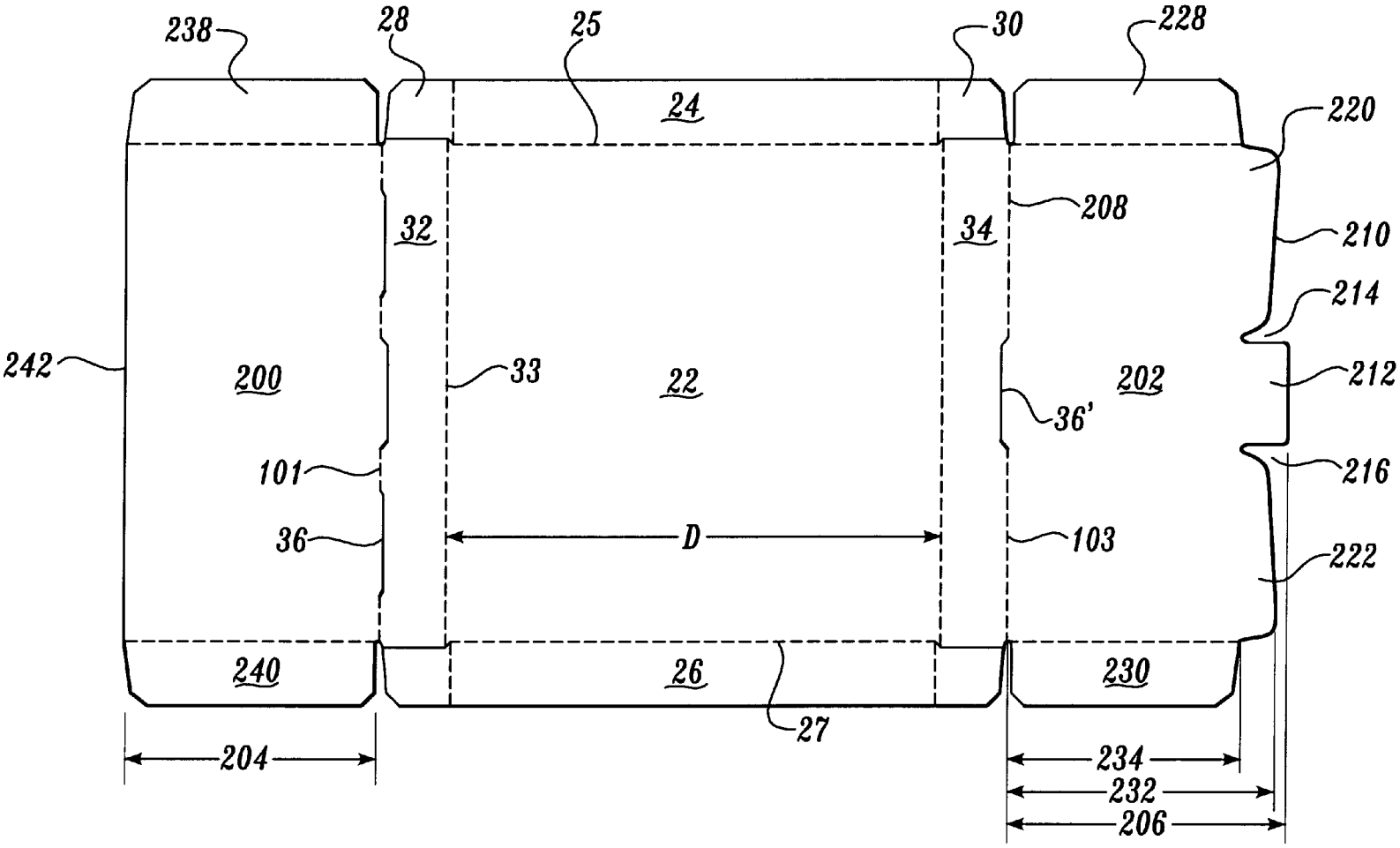
FIG. 4 is a second embodiment of a single-piece box blank formed in accordance with the present invention.
Figure 5:
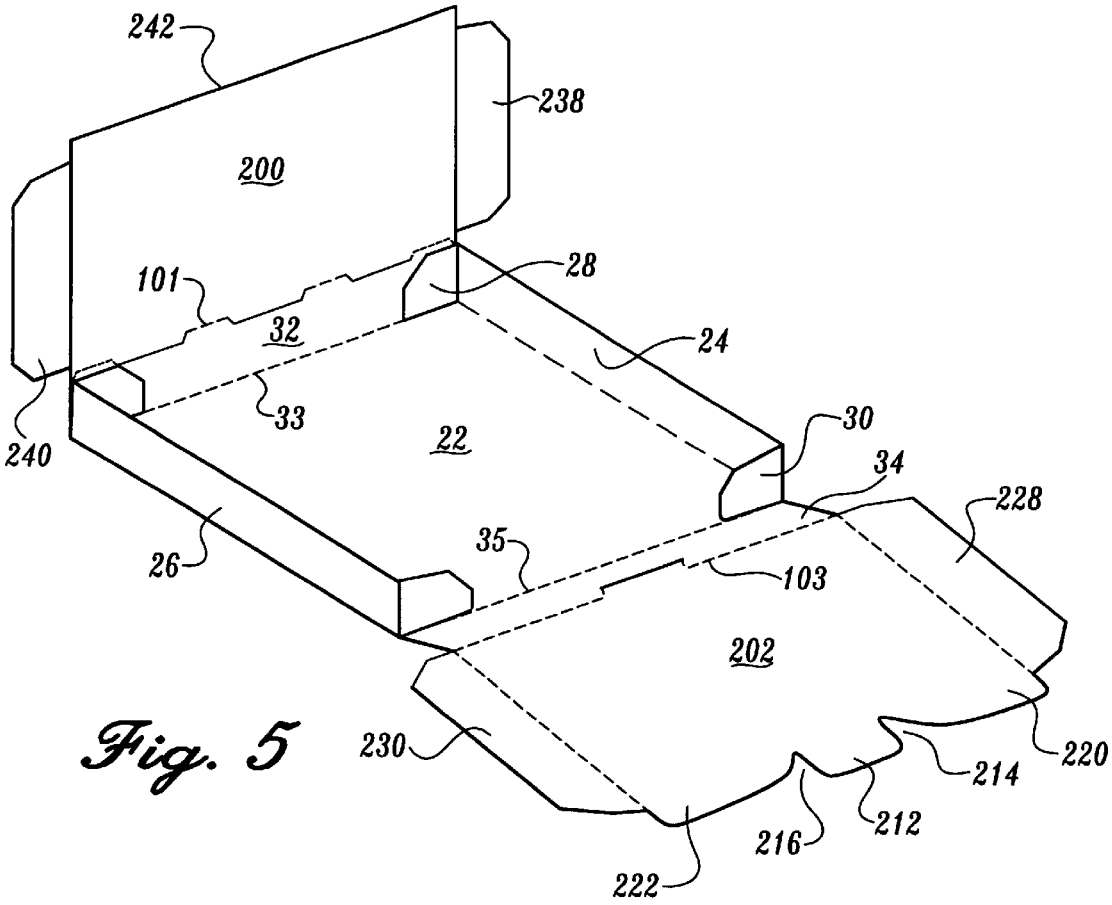
FIGS. 5 and 6 are isometric views illustrating assembly of the box of FIG. 4.
Figure 6:
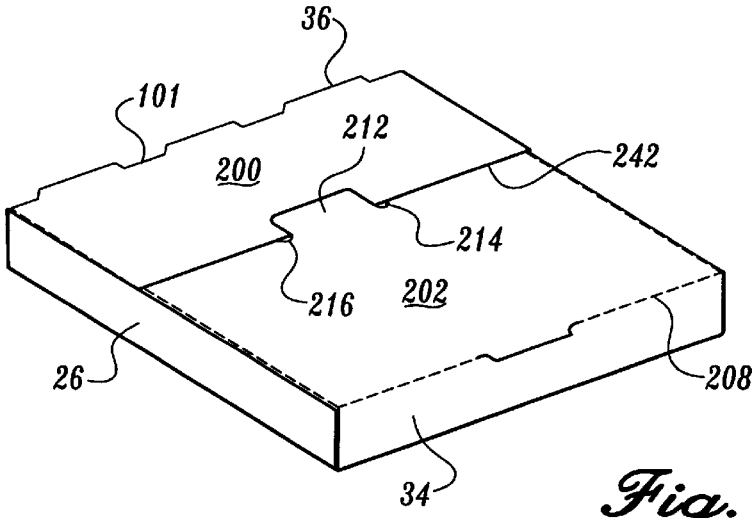
Figure 7:
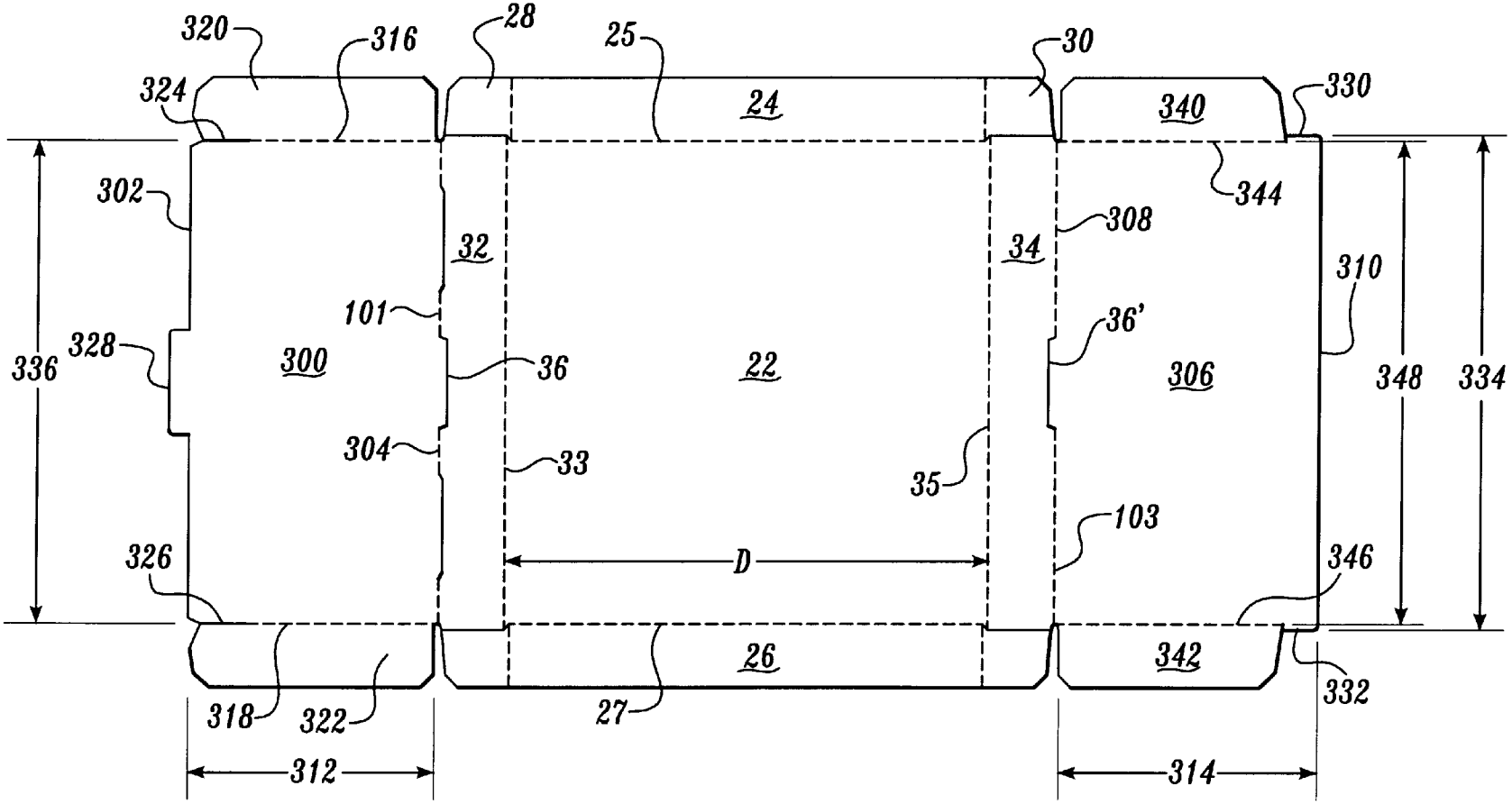
FIG. 7 is a third embodiment of a single-piece box blank formed in accordance with the present invention.
Figure 8:
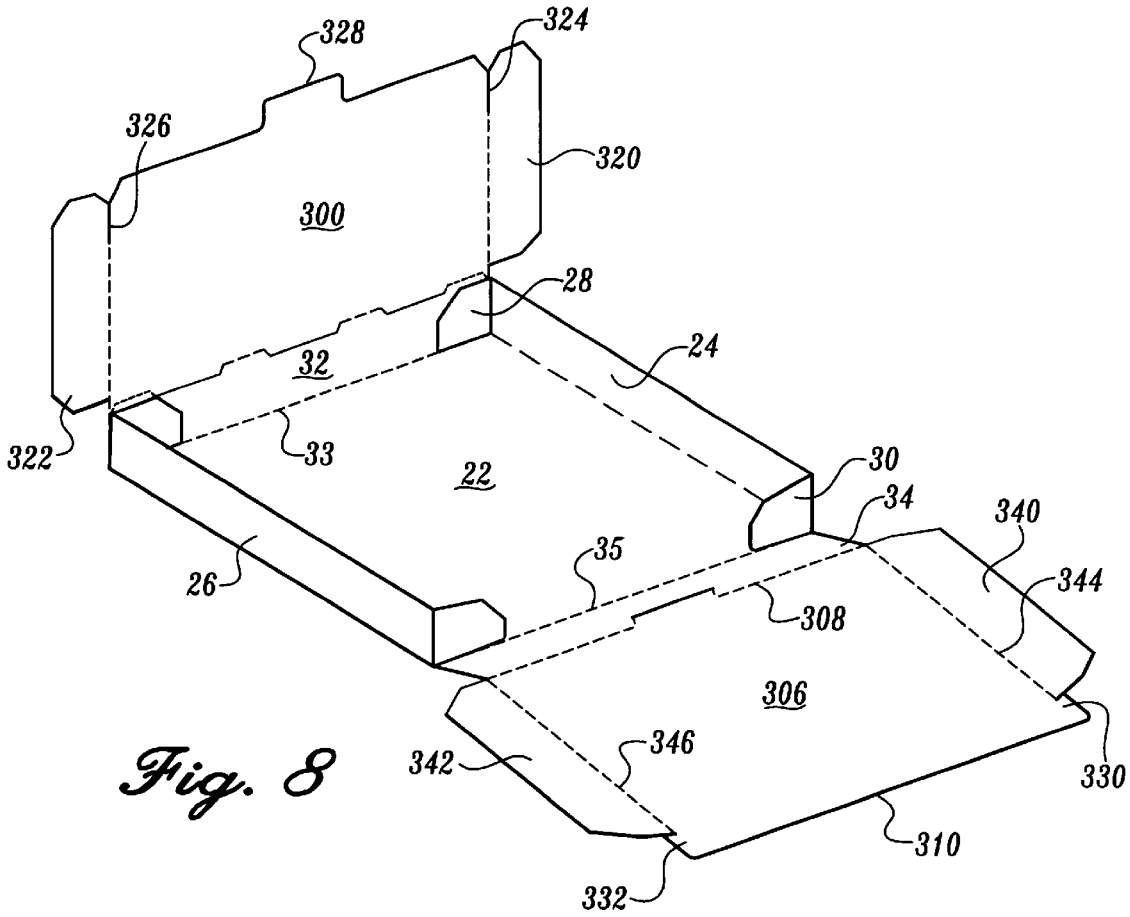
FIGS. 8 and 9 are isometric views illustrating assembly of the box of FIG. 7.
Figure 9:
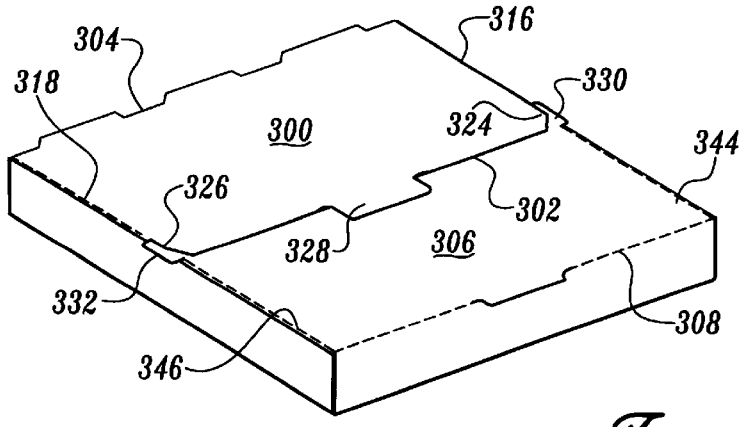

The present invention is an improvement to a pizza-style paperboard container. Such containers are, in general, relatively flat and square in shape. According to the present invention a number of unique features are provided in which the resulting container is easy to set up and handle. Various types of lock mechanisms are described to maintain the container in a closed state. In particular, FIGS. 1–3 illustrate a first embodiment of a lock mechanism in which side slots are used to engage a top cover panel with the container's side wall panels. FIGS. 4–6 illustrate a second embodiment having a distinct tab engagement arrangement. FIGS. 7–9 illustrate a third embodiment that utilizes side extensions. And FIGS. 1–12 show a fourth embodiment using side protrusions that insert into corresponding openings.

Referring to FIG. 1, a container of the present invention is formed from a single piece blank 20 of paperboard material. The container includes a generally rectangular bottom panel 22 having four edges and a depth dimension D. Unless otherwise apparent, the term "edges" refers generally to a fold or score line. First and second opposing side wall panels 24, 26 are hingedly connected to opposing side edges of the bottom panel along hinge lines 25 and 27, respectively. Each side wall includes first and second end flaps 28, 30. The side wall panels are preferable formed of a single layer of corrugated material. Rolled-over side wall panels may be used, but will not result in an optimal arrangement. First and second opposing end wall panels 32, 34 are hingedly connected to the remaining two opposing edges of the bottom panel 22 along hinge lines 33 and 35, respectively.

As assembled, the side walls and end walls are each upright, with the end flaps of the side walls being folded inwardly 90 degrees so that they are adjacent to the inner surface of the end wall panels 32, 34. The container may include further elements as needed for a particular application, e.g., vents to aid in releasing steam, specialized liners or grease barriers, etc. The depth dimension of the bottom panel is measured from the opposed edges joining the first and second end wall panels to the bottom panel. As shown in FIG. 3, the height H of the container as assembled is substantially less than the container depth D or width W.

Still referring to FIG. 1, a first embodiment of a lock mechanism is shown including a first top cover panel 100 connected to the first end wall panel 32 along a hinge line 101. Also includes is a second top cover panel 102 connected to the second end wall panel 34 along a hinge line 103. Both the first and second top cover panels 100, 102 have a depth dimension, 104 and 106 respectively, sized less than the depth dimension D of the bottom panel 22. When assembled, portions of the first and second top cover panels 100, 102 overlap by a small amount.

The hinge line 101 includes three cuts, each labeled 36. The cuts 36 are generally modified U-shapes facing the first top cover panel 101. The U-shape includes an open side and a closed side. This shape gives the cuts 36 a depth dimension that extends into the first end panel 32 (or alternatively into the first top cover panel). The open side of the U-shape aligns with the hinge line 101. Similarly, the second top cover panel may include a cut 36' along its hinge line 103. These cuts 36 and 36' are useful during the assembly process, as described below. In one embodiment, there are three cuts 36 along the hinge line 101, resulting in four hinged connections spaced equally apart along the hinge line 101.

The first and second opposing side wall panels each includes an upright slot 108, 110 extending in a downward direction from each side wall panel upper edge. Each slot extends downward approximately one half the height distance of the side wall panel. The second top cover panel 102 includes first and second outer flaps 112, 114 hingedly connected to opposed side edges of the second top cover panel. The first top cover panel 100 may optionally include third and fourth outer flaps 116, 118 hingedly connected to opposed side edges of the first top cover panel.

Each outer flap 112, 114 of the second top cover panel 102 has a corresponding slot 120 extending in an inward direction from an outer edge of the outer flap. As assembled, the corresponding slots 120 extend upward approximately one half the height distance of the outer flaps. See FIG. 3. In the embodiment shown, a single corresponding slot 120 is provided roughly midway along each outer flap 112, 114, with the slots 108, 110 located at the same depth along the first and second side wall panels 24, 26, respectively. This is referred to generally as a "scissor lock." The slots 108, 110, 120 are generally V-shaped. In one embodiment, one edge 122 of the V-shaped slots is angled from an orthogonal line 124 by an amount in the range of about 10 degrees to about 30 degrees.

In one embodiment, the first and second outer flaps 112, 114 each include a fold line 126 extending generally parallel to each outer flap lower edge and extending from the slot 120 toward the second end wall panel 34. This fold line is very useful in allowing an operator to set up a pizza box in a minimum amount of time, by easing the engagement of the scissor lock. Also shown in FIG. 1, the outer flaps 112, 114, 116, 118 are preferably clipped or rounded at their outer corners. Clipped corners ease assembly of the container and reduce assembly time as well.

Referring to FIGS. 2 and 3, to close and lock the container, the side wall panels 24 and 26 are folded upright and their outer end flaps 28 are folded inward. The first end wall panel 32 and first top cover panel 100 are folded upright relative to the bottom panel 22 along hinge line 33. Next, the first top cover panel 100 is folded about its hinge line 101 with the first end wall panel 32. This causes the cuts 36 to "pop" out of the plane of the first end wall panel 32. The edges of the U-shaped portion extend rearward. The friction between the cut edge on the first end wall panel 32 and the extended U-shaped portion helps to maintain the first top cover panel 100 in a folded in orientation. In general, once folded inward, the first top cover panel 101 will naturally rest at an angle in the range of about 90 degrees to about 105 degrees from the upright first end wall panel 32.

It is the inventor's understanding that dual half-lid configurations (also called harness-style boxes) are not used in pizza containers because of problems in forming the container. There is a tendency for the back half lid to resist staying folded, thus requiring more effort than desired. The use of cuts 36 causes the first top cover panel 100 to naturally fold into the container, thereby aiding the assembly process.

The outer flaps 116, 118 of the first top cover panel tuck inward of the opposing side wall panels 24, 26. The second top cover panel 102 and second end wall panel 34 are folded upright along hinge line 35. The second top cover panel 102 is folded inward along hinge line 103. The outer flaps 112, 114 of the second top cover panel are folded downward. The portion of the outer flap nearest the second end wall panel 34 is tucked inward of the side wall panels 24, 26, with the score line 126 helping in the insertion. The slots of the outer flaps 120 engage the slots 108 and 110 of the side walls 24 and 26. The remaining portions of the outer flaps are positioned exterior to the side wall 24, 26 as assembled.

Referring to FIGS. 4–6, a second embodiment of a lock mechanism is shown including a first top cover panel 200 hingedly connected to the first end wall 32 panel and a second top cover panel 202 hingedly connected to the second end wall panel 34. Both the first and second top cover panels 200, 202 have a depth dimension, 204 and 206 respectively, sized less than the depth dimension D of the bottom panel 22. When assembled, portions of the first and second top cover panels will overlap as described below.

The second top cover panel 202 has front and rear edges 208, 210. At least one tab 212 is formed in the rear edge 208. The tab 212 is defined between a pair of edge slots 214, 216 oriented generally transverse to the rear edge 208. As in the first embodiment, the edge slots 214, 216 are generally V-shaped. In one embodiment, the outer edge of the V-shaped slot is angled away from an orthogonal line by an amount in the range of about 10 degrees to about 30 degrees. The rear edge 208 of the second top cover panel 202 further includes top flaps 220, 222 located on each side of the tab 212. The top flaps 220, 222 are shaped to angle inwardly in going toward the tab 212.

The second top cover panel 202 includes opposed side edges and first and second outer flaps 228, 230 hingedly connected thereto. As shown in the embodiment of FIG. 4, the overall depth dimension 206 of the second top cover panel 202 is greater than the depth dimension 232 of the second top cover panel at the top flaps 220, 222. Each outer flap 228, 230 has a depth dimension 234 that is less than the depth dimension 232 at the top flaps 220, 222. The first top cover panel 200 includes opposed side edges and may also include third and fourth outer flaps 238, 240 hingedly connected to the opposed side edges. As with the first embodiment, the outer flaps are preferably clipped at their outer corners to ease assembly of the container.

Referring to FIGS. 5 and 6, to close and lock the container, the side wall panels 24 and 26 are folded upright and their outer end flaps 28 are folded inward. The first end wall panel 32 and first top cover panel 200 are folded upright relative to the bottom panel 22 along hinge line 33. Next, the first top cover panel 200 is folded about hinge line 101 relative to the first end wall panel 32. This causes the cuts 36 to "pop" out of the plane of the first end wall panel 32 as described above.

The outer flaps 240, 238 of the first top cover panel tuck inward of the opposing side wall panels 24, 26. The second top cover panel 202 and second end wall panel 34 are folded upright along hinge line 35. The second top cover panel 202 is folded about its hinge line 103 with the second end wall panel 34. The outer flaps 228, 230 of the second top cover panel 202 are folded inward and tucked into the side wall panels 24, 26. In one embodiment, the outer flaps 238, 240 and 228, 230 of the first and second top cover panels do not conflict or overlap with one another.

Portions of the first top cover panel 200 are then positioned between the at least one tab 212 and the top flaps 220, 222 of the second top cover panel 202. The first top cover panel passes through the edge slots of the second top cover panel. In the arrangement of FIG. 6, the tab 212 is located above the first top cover panel 200, and the top flaps 220, 222 are located below the first top cover panel 200. Other arrangements are possible.

Referring to FIGS. 7–9, a third embodiment of a lock mechanism is shown including a first top cover panel 300 having front and rear edges 302, 304 and a second top cover panel 306 having front and rear edges 308, 310. The first top cover panel 300 is hingedly connected at its rear edge 304 to the first end wall panel 32. The second top cover panel 306 is hingedly connected at its front edge 308 to the second end wall panel 34. Both the first and second top cover panels 300, 302 have a depth dimension, 312 and 314 respectively, sized less than the depth dimension D of the bottom panel 22. When assembled, portions of the first and second top cover panels overlap by a small amount.

The first top cover panel includes opposed first and second side edges 316, 318 and first and second side flaps 320, 322 hingedly connected to the opposed side edges 316, 318, respectively. The first top cover panel 300 further includes transverse cuts 324, 326 along the front edge 302, at the hinged connection between the first top cover panel 300 its side flaps 320, 322. The transverse cuts 324, 326 extend only partially along the hinged connection therebetween. The side flaps 320, 322 and front edge 302 of the first cover panel 300 are preferably clipped at the transverse cuts 324, 326 to ease assembly. The first top cover panel 300 may further include an optional front tab 328 along the first top cover panel front edge 302.

The second top cover panel 306 includes side extensions 330, 332 along its rear edge 310. The second top cover panel 306 has a width dimension 334 between side extensions 330, 332 that is larger than the width dimension 336 between side cuts 324, 326 in the first top cover panel 300. The second top cover panel 306 includes optional third and fourth side flaps 340, 342 hingedly connected to opposed side edges 344 and 346 respectively, of the second top cover panel 306. The width dimension 334 at the side extensions 330, 332 is also larger than the width dimension 348 between the fold lines 334, 346 joining the third and fourth side flaps to the second top cover panel.

Referring to FIGS. 8 and 9, to close and lock the container, the side wall panels 24 and 26 are folded upright and their outer end flaps 28 are folded inward. The first end wall panel 32 and first top cover panel 300 are folded upright relative to the bottom panel 22 along hinge line 304 (also numbered 33). Next, the first top cover panel 100 is folded about its hinge line 101 with the first end wall panel 32. This causes the cuts 36 to "pop" out of the plane of the first end wall panel 32 as described above.

The outer flaps 320, 322 tuck inward of the opposing side wall panels 24, 26, respectively. The second top cover panel 306 and second end wall panel 34 are folded upright along hinge line 35. The second top cover panel 306 is folded about its hinge line 308 (also labeled 103) with the second end wall panel 34. The outer flaps 340, 342 of the second top cover panel are folded and tucked inward of the side wall panels 24, 26. In one embodiment, the outer flaps 320, 322 and 340, 342 of the first and second top cover panels do not conflict or overlap with one another. The side extensions 330, 332 of the second top cover panel are inserted into the transverse cuts 324, 326, respectively, of the first top cover panel front edge 302.

Figure 10:
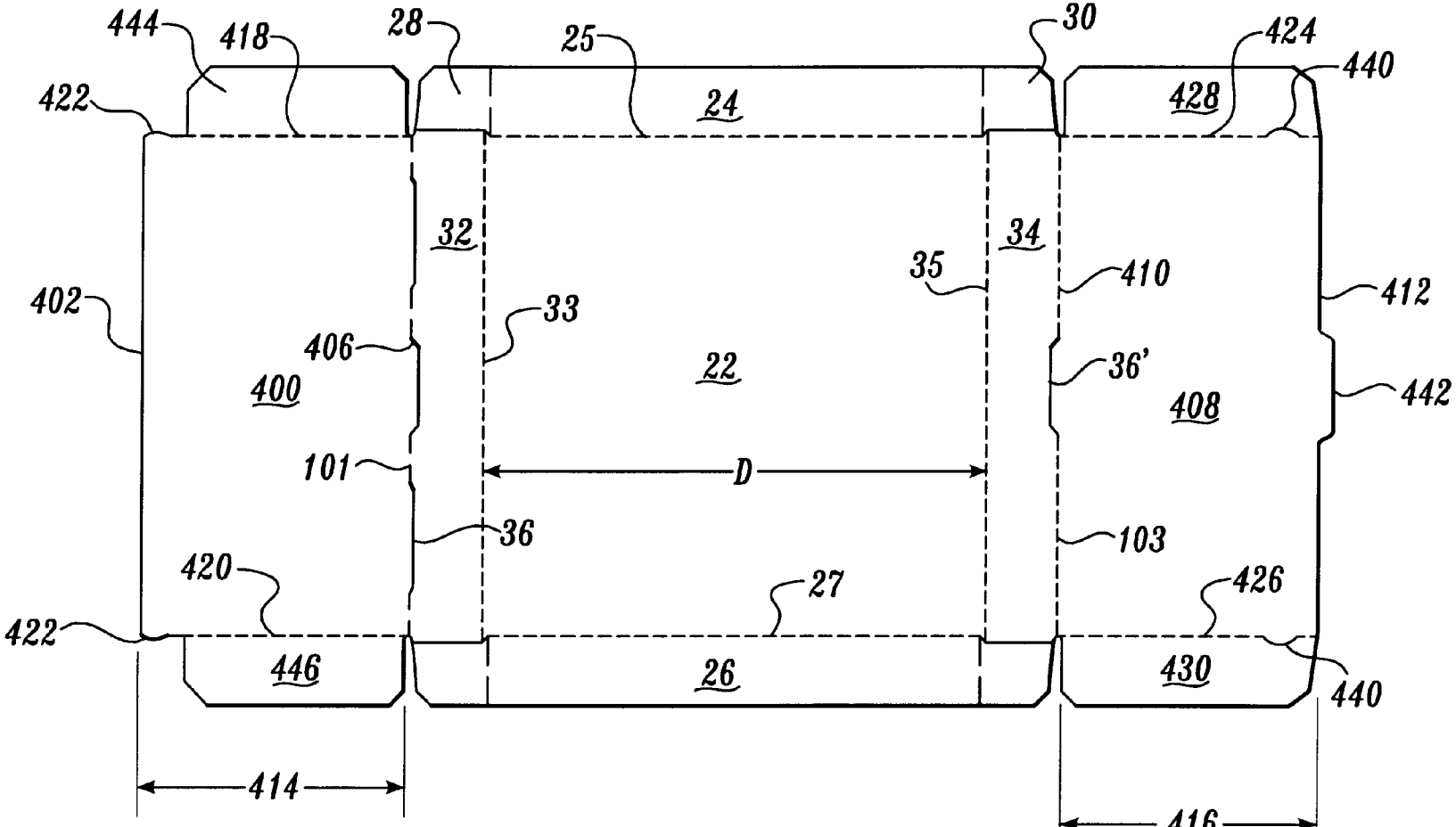
FIG. 10 is a fourth embodiment of a single-piece box blank formed in accordance with the present invention.
Figure 11:
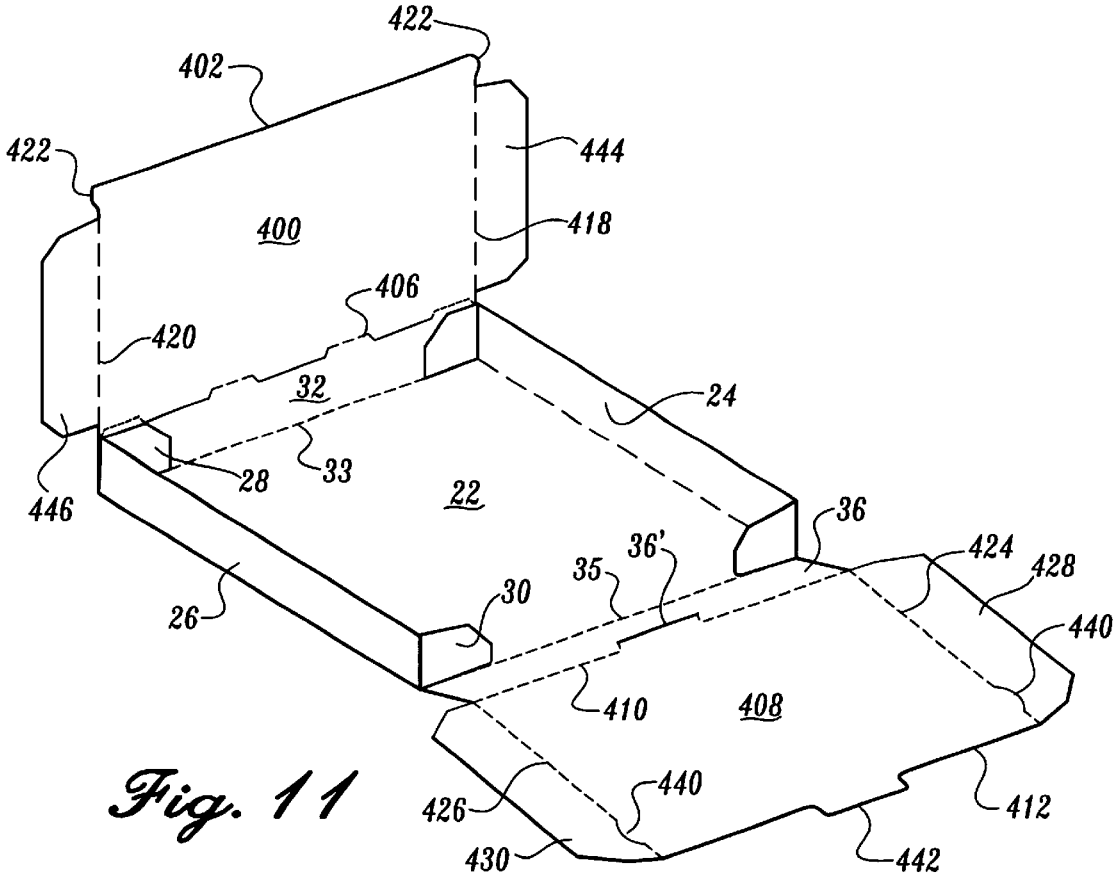
FIGS. 11 and 12 are isometric views illustrating assembly of the box of FIG. 10.
Figure 12:
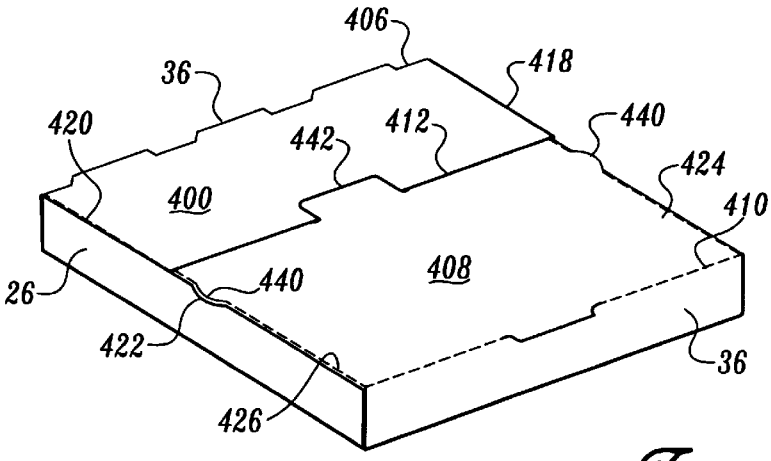

Referring to FIGS. 10–12, a fourth embodiment of a lock mechanism is shown including a first top cover panel 400 having front and rear edges 402, 406, and a second top cover panel 408 having front and rear edges 410, 412. The first top cover panel 400 is hingedly connected at its rear edge 406 to the first end wall panel 32. The second top cover panel 408 is hingedly connected at its front edge 410 to the second end wall panel 34. Both the first and second top cover panels 400, 408 have a depth dimension, 414 and 416 respectively, sized less than the depth dimension D of the bottom panel 22. When assembled, the first and second top cover panels overlap by a small amount.

The first top cover panel further includes opposed first and second side edges 418, 420, and side protrusions 422 extending along both side edges near the front edge 402. The second top cover panel also includes opposed first and second side edges 424, 426, with side flaps 428, 430, respectively, hingedly connected to each opposed side edge. The second top cover panel includes slits 440 provided in the hinge lines 424, 426 between the side flaps 428, 430 and the second top cover 408. The slits 440 are along the hinge line, though preferably not colinear. In one embodiment, the slits 440 are outwardly arcuate in shape. The second top cover panel 408 may include a rear tab 442 along the second top cover panel rear edge 412. In the embodiment of FIG. 10, the first top cover panel 400 includes optional third and fourth side flaps 444, 446 hingedly connected to opposed side edges of the first top cover panel. The side flaps of the first and second cover panels are preferably clipped at their outer corners to ease assembly.

Referring to FIGS. 11 and 12, to close and lock the container, the side wall panels 24 and 26 are folded upright and their outer end flaps 28 are folded inward. The first end wall panel 32 and first top cover panel 400 are folded upright relative to the bottom panel 22 along hinge line 33. The first top cover panel 400 is folded along its hinge line 406 (also labeled item 101) with the first end wall panel 32. This causes the cuts 36 to "pop" out of the plane of the first end wall panel 32 as described above.

The outer flaps 444, 446 tuck inward of the opposing side wall panels 24, 26. The second top cover panel 408 and second end wall panel 34 are folded upright along hinge line 35. The second top cover panel 408 is folded about its hinge line 410 (also labeled item 103) with the second end wall panel 34. The outer flaps 428, 430 of the second top cover panel are folded and tucked inward of the side wall panels 24, 26. In one embodiment, the outer flaps 444, 446 and 428, 430 of the first and second top cover panels do not conflict or overlap with one another. The first top cover panel 400 is positioned below the second top cover panel 408, and the side protrusions 422 are inserted into the slits 440.

As will be appreciated from a reading of the above, the present invention avoids many of the problems of prior art boxes. The present invention is easy to set up and handle, and includes parts which may be secured together with a minimum effort to provide a practically permanent connection therebetween. The side wall panels are of a single thickness, so that the disadvantages of rolled side walls are not present. Additional benefits include the ability to open only half of the container lid. This prevents heat loss to the pizza when attempting to inspect the box contents. The arrangement of the end panels with the top cover panels allows the consumer to remove a slice of pizza without exposing the entire pie to rapid cooling.

While the preferred embodiment of the invention has been illustrated and described, it will be appreciated that various changes can be made therein without departing from the spirit and scope of the invention. For example, preferred embodiments of the present invention avoid rolled side walls. Such rolled side walls may be used however if they are desirable for a particular application. Thus, it is to be understood that the invention is defined according to the claims provided herein, such claims not delineating side wall configuration.

The embodiments of the invention in which an exclusive property or privilege is claimed are defined as follows:

1. In a container blank formed from a single piece of paperboard material, the assembled container for holding a pizza; the blank including a generally rectangular bottom panel having four edges and a depth dimension; first and second opposing side wall panels each hingedly connected to opposing edges of the bottom panel; first and second opposing end wall panels hingedly connected to the remaining two opposing edges of the bottom panel; the depth dimension of the bottom panel being measured from the opposing edges of the bottom panel connecting to the first and second end wall panels; the height of the container as assembled being substantially less than the container depth or width; an improvement comprising:

a first top cover panel connected to the first end wall panel along a first hinge line, the first top cover panel having a depth dimension sized less than the depth dimension of the bottom panel;

at least one U-shaped cut formed along the first hinge line, the U-shape cut forming a portion having a closed side and an open side, the cut being oriented with the closed side extending into one of the first end wall panel and the first top cover panel, the open side being positioned along the first hinge line, wherein as assembled the U-shaped portion is generally perpendicular with the panel from which it was formed; and a second top cover panel having front and rear edges, the second top cover panel being hingedly connected at its front edge to the second end wall panel, the second cover panel having a depth dimension sized less than the depth dimension of the bottom panel.

2. The improvement according to claim 1, wherein the at least one U-shaped cut includes at least three U-shaped cuts positioned in spaced apart relation.

3. The improvement according to claim 1, wherein the at least one U-shaped cut is oriented with the closed side extending into the first end wall panel, and as assembled the U-shaped portion is coplanar with the first top cover panel.

4. The improvement according to claim 1, further comprising a lock mechanism to maintain the first and second top cover panels in a closed position.

5. The improvement according to claim 4, wherein the lock mechanism includes first and second opposing side wall panels each having an upright slot extending in a downward direction from each side wall panel upper edge; and wherein the second top cover panel includes first and second outer flaps hingedly connected to opposed side edges of the second top cover panel, each outer flap having a corresponding slot extending in an upward direction from a lower edge of the outer flap; as assembled, the outer slots engage the corresponding slots in the opposing side wall panels.

6. The improvement according to claim 5, wherein the slots of the side wall panels and the corresponding slots first and second outer flaps extend approximately one half the height distance of the side wall panels and outer flaps, respectively.

7. The improvement according to claim 5, wherein as assembled, portions of the first and second top cover panels overlap.

8. The improvement according to claim 5, wherein the first and second outer flaps each include a fold line extending generally parallel to each outer flap lower edge and extending between an inner portion of the slot in the outer flap and one of the second top cover panel front and rear edges.

9. The improvement according to claim 8, wherein the fold line extends between the inner portion of the slot in the outer flap and the rear edge of the top cover panel.

10. The improvement according to claim 4, wherein the lock mechanism includes an arrangement in which the second top cover panel includes at least one tab formed in its rear edge, the tab being defined between a pair of edge slots oriented generally transverse to the rear edge, the rear edge further including top flaps located on each side of the tab; and wherein as assembled, the first top cover panel is positioned between the at least one tab and the top flaps of the second top cover panel, the first top cover panel passing through the edge slots of the second top cover panel, portions of the first and second top cover panels overlapping.

11. The improvement according to claim 10, wherein as assembled the tab is located above the first top cover panel and the top flaps are located below the first top cover panel.

12. The improvement according to claim 10, wherein the top flaps are shaped to angle inwardly.

13. The improvement according to claim 10, wherein the second top cover panel includes opposed side edges and first and second outer flaps hingedly connected thereto, each outer flap having a depth dimension less than the overall depth dimension of the second top cover panel.

14. The improvement according to claim 13, wherein the overall depth dimension of the second top cover panel is greater than the depth dimension of the second top cover panel top flaps.

15. The improvement according to claim 13, wherein the first top cover panel includes opposed side edges and third and fourth outer flaps hingedly connected thereto; as assembled, the first and third outer flaps are positioned inside of the first side wall panel and the second and fourth outer flaps are positioned inside of the second side wall panel.

16. The improvement according to claim 15, wherein as assembled, the outer flaps of the first and second top cover panels do not conflict or overlap with one another.

17. The improvement according to claim 4, wherein the lock mechanism includes an arrangement in which the first top cover panel includes front and rear edges, the first top cover panel being connected at its rear edge to the first end wall panel along a first hinge line, the first top cover panel including opposed first and second side edges and side flaps hingedly connected to the opposed side edges, the first top cover panel including transverse cuts along the front edge at the hinged connection between the side flaps, the transverse cuts extending partially along the hinged connection;

wherein the second top cover panel includes side extensions along its rear edge, the second top cover panel having a width dimension between side extensions larger than the width dimension between side cuts in the first top cover panel; and wherein as assembled, the side extensions of the second top cover panel are inserted into the transverse cuts of the first top cover panel front edge, portions of the first and second top cover panels thereby overlapping.

18. The improvement according to claim 17, wherein the side flaps and front edge of the first cover panel are both clipped at the transverse cuts to ease assembly.

19. The improvement according to claim 4, wherein the lock mechanism includes an arrangement in which a first top cover panel has front and rear edges, the first top cover panel being connected at its rear edge to the first end wall panel along the first hinge line, the first top cover panel including opposed first and second side edges and side protrusions extending along the opposed side edges near the front edge;

wherein the second top cover panel including opposed first and second side edges, a side flap being hingedly connected to each opposed side edge, the second top cover panel including slits provided along the hinged connections between the side flaps and the second top cover; and wherein as assembled, the side flaps of the second top cover panel are inside of the first and second side wall panels, the first top cover panel is below the second top cover panel, and the side protrusions of the first top cover panel are inserted into the slits of the second top cover panel, portions of the first and second top cover panels thereby overlapping.

20. The improvement according to claim 19, wherein the slits are located along the hinge line though not colinear with the hinge line, the slits having an outwardly oriented arcuate shape.

* * * * *